US006666298B2

(12) United States Patent
Volkman

(10) Patent No.: US 6,666,298 B2
(45) Date of Patent: Dec. 23, 2003

(54) HANGING SCAFFOLD SUPPORT

(76) Inventor: John Volkman, 1170 N. Lincoln, Suite 101, Dixon, CA (US) 95620

( * ) Notice: Subject to any disclaimer, the term of this patent is extended or adjusted under 35 U.S.C. 154(b) by 148 days.

(21) Appl. No.: 09/991,032

(22) Filed: Nov. 21, 2001

(65) Prior Publication Data

US 2002/0139614 A1 Oct. 3, 2002

(51) Int. Cl.[7] ..... E04G 3/00
(52) U.S. Cl. ..... 182/82; 182/150; 248/221.12
(58) Field of Search ..... 182/82, 150; 248/221.12

(56) References Cited

U.S. PATENT DOCUMENTS 3,603,637 A * 9/1971 Depinto
4,971,169 A 11/1990 Fruth
5,299,654 A 4/1994 Duncan
5,524,727 A 6/1996 Yennie, Jr.
5,638,917 A 6/1997 Vennen
5,664,391 A 9/1997 Bartholomew
5,829,549 A 11/1998 Flynn
5,865,410 A * 2/1999 Horen
6,003,630 A 12/1999 Whalen
6,003,631 A 12/1999 Knauth
6,053,280 A 4/2000 Smith et al.
2002/0027043 A1 * 3/2002 Wisler

* cited by examiner

*Primary Examiner*—Alvin Chin-Shue

(57) ABSTRACT

A scaffolding support designed to hang from the top of a wall and further designed to allow a complete roof including a frieze block to be installed without removing the hanging scaffolding support. The hanging scaffolding support is further designed to be removable with a frieze block installed. The hanging scaffolding support includes a wall securing assembly, a vertical support, a horizontal support, and a vertical safety rail support.

2 Claims, 5 Drawing Sheets

FIG. 3
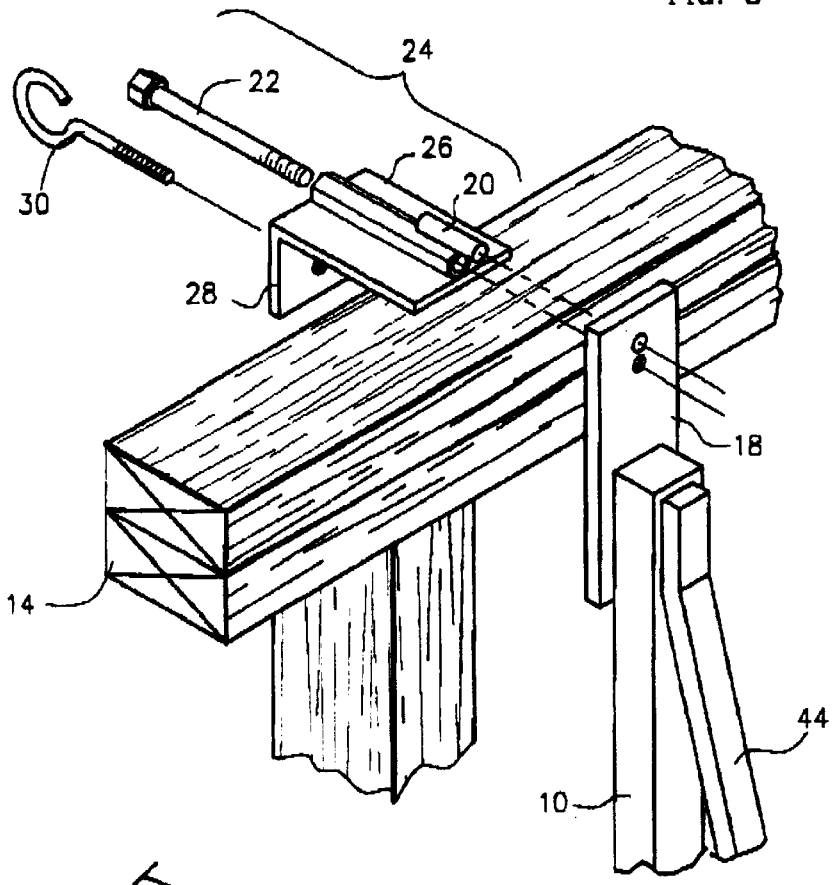
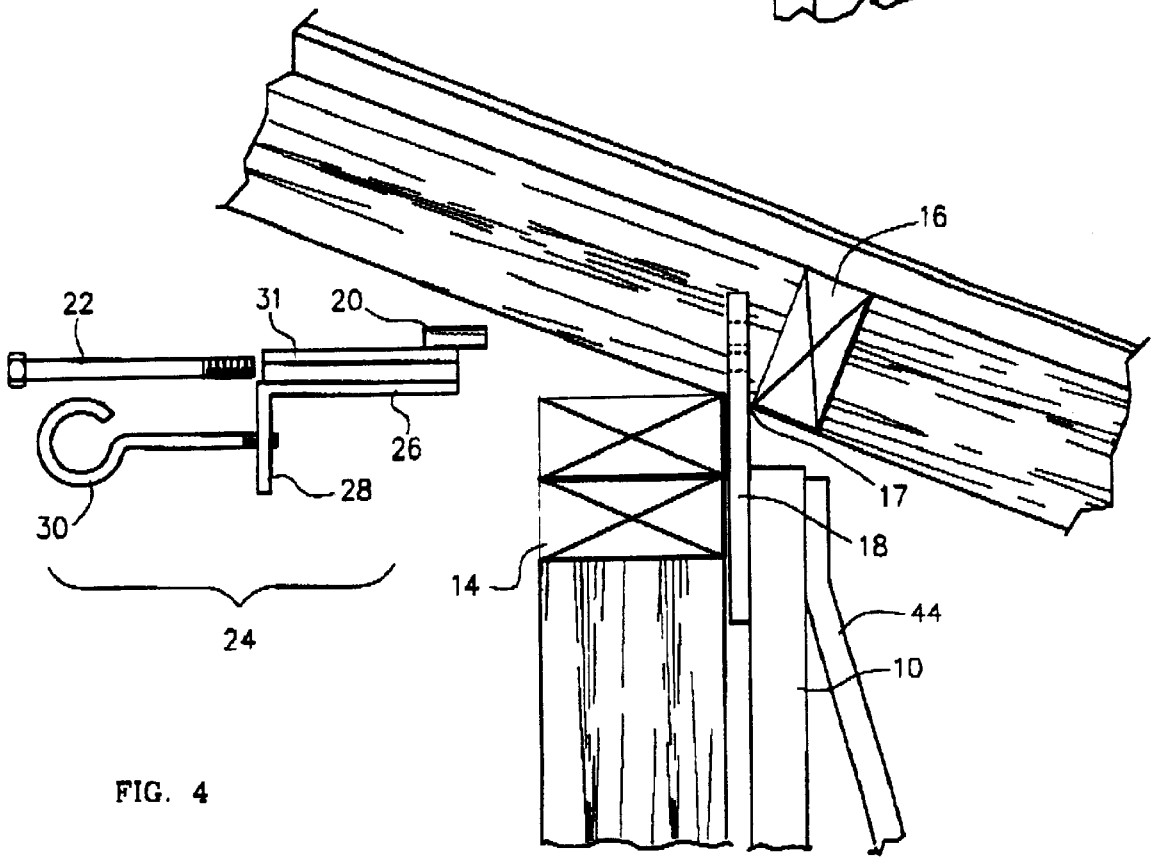
FIG. 4

HANGING SCAFFOLD SUPPORT

1. THE FIELD OF THE INVENTION

The invention relates to means and methods for supporting workers, tools and materials above ground level during construction of buildings. More particularly, the invention relates to removable scaffolding systems that allow for the completion of roof systems before removing the scaffolding.

2. THE BACKGROUND ART

Conventional scaffolding has long been used in the construction industry to allow workers to work above or below ground level. Conventional scaffolding, however, presents multiple disadvantages. Conventional scaffolding is heavy and bulky. It requires large amounts of time and energy to set up and take down. In addition, scaffolding may be subject to multiple state and federal regulations. In many instances, conventional scaffolding is not practical. For example, the ground upon which the base of conventional scaffolding must be placed may be uneven or obstacles may be present that make the placement of conventional scaffolding impractical or impossible. In addition, workers may be required to work at a height that makes conventional scaffolding impractical due to the massive amount of materials and time that would be required to build such a scaffold.

Ladders are subject to many of the above concerns such as problems with uneven ground, obstacles preventing placement in particular locations, and a limited height to which a ladder can reach. In addition, to perform work on a linear section of wall wider than an arm's length, the ladder must be repeatedly moved. Furthermore, the amount and weight of tools and equipment that can be carried up a ladder and used is limited.

Several scaffolding systems that hang from the top of a wall or a roof have been suggested in the prior art. These systems overcome many of the problems with conventional scaffolding and ladders that are noted above. Because such systems do not rest on the ground, obstacles and uneven ground are not an impediment to the use of such systems. Examples of such systems include U.S. Pat. No. 4,971,169 (Fruth), U.S. Pat. No. 5,524,727 (Yennie Jr.), U.S. Pat. No. 5,664,391 (Bartholomew), U.S. Pat. No. 5,829,549 (Flynn), U.S. Pat. No. 6,003,630 (Whalen), U.S. Pat. No. 6,003,631 (Knauth), and U.S. Pat. No. 6,053,280 (Smith et al.).

A difficulty which has yet to be overcome by such systems, however, is that all of the systems known in the prior art must be removed before a frieze block may be installed and a roof may be completely finished. Thus, a ladder or conventional scaffolding must still be used at some point to complete the roof. What is needed is a scaffolding system that incorporates all of the advantages of a hanging scaffolding system but allows a roof to be completed while the scaffolding is still in place.

Typical roofs on modern residential construction often incorporate a frieze block to span the gap between the underside of the roof decking and the top plate of the outside wall. Typically, a gap of less than one and one-half inches is left between the proximate corner of the frieze block and the top plate of the wall. This gap is eventually filled with the sheathing and coating that is applied to the exterior of the wall. One aspect of the present invention is that the frieze block may be completely installed while the scaffolding is functional and in place. Accordingly, a safety barrier to prevent workers from falling from the roof can remain in place until the roof is completely finished. That aspect of the invention eliminates the need to use ladders, conventional scaffolding, safety harnesses or other awkward and/or cumbersome methods to complete a roof installation.

3. BRIEF SUMMARY OF THE INVENTION

The present invention consists of a hanging scaffolding support having a vertical member, a horizontal member for supporting a worker and equipment support surface and a second vertical member for supporting one or more safety rails. Various braces may be incorporated connecting the horizontal member to the vertical member to provide the requisite strength to support workers, equipment and materials. Additional features may be included to ensure the proper positioning of the worker and equipment support surface. The hanging scaffolding support is adapted to allow a roof system incorporating a frieze block to be completed before the scaffolding support must be removed. The support may be further adapted to allow the scaffolding support to be removed without lifting the scaffolding support over the wall and without moving the vertical member horizontally away from the wall or other surface from which the scaffolding support is hanging.

One embodiment of the invention that allows a roof system incorporating a frieze block to be completed without removing the scaffolding support comprises a vertical support adapted to receive a shear pin and an attachment bolt and further adapted to extend behind a frieze block when the frieze block is in place. This embodiment incorporates a top plate clamp assembly comprising a horizontal plate, a wall tab depending from the horizontal plate, a shear pin attached to the horizontal plate and adapted to mate with the vertical support, an attaching bolt adapted to mate with the vertical support and attach the top plate clamp assembly to the vertical support, and a wall engaging bolt to hold the scaffolding support against a wall or other structure. The vertical support extends vertically down, substantially parallel to the wall. A horizontal support for supporting a worker and equipment support surface is attached to the vertical support below the portion of the vertical support that mates with the top plate clamp assembly. Various braces may be incorporated connecting the horizontal member to the vertical member to provide the requisite strength to support workers, equipment and materials. Additional features may be included to ensure the proper positioning of the worker and equipment support surface. A vertical safety rail support member may be removably or permanently attached to the end of the horizontal support member opposite the vertical support. The vertical safety rail support member may be adapted to receive at least one horizontal safety rail.

Although the present invention has been described in terms of certain preferred embodiments and exemplified with respect thereto, one skilled in the art will readily appreciate that various modifications, changes, omissions and substitutions may be made without departing from the spirit and scope of the present invention. It is intended that the present invention be limited solely by the scope of the claims.

4. BRIEF DESCRIPTION OF THE DRAWINGS

FIG. 3 is a perspective exploded view showing how the top plate clamp assembly mates with the vertical support in one embodiment of the invention;

FIG. 4 is a partially exploded side view showing how the top plate clamp assembly of one embodiment of the invention may be removably attached to the vertical support despite the presence of a complete roof system incorporating a frieze block;

Figure 5:
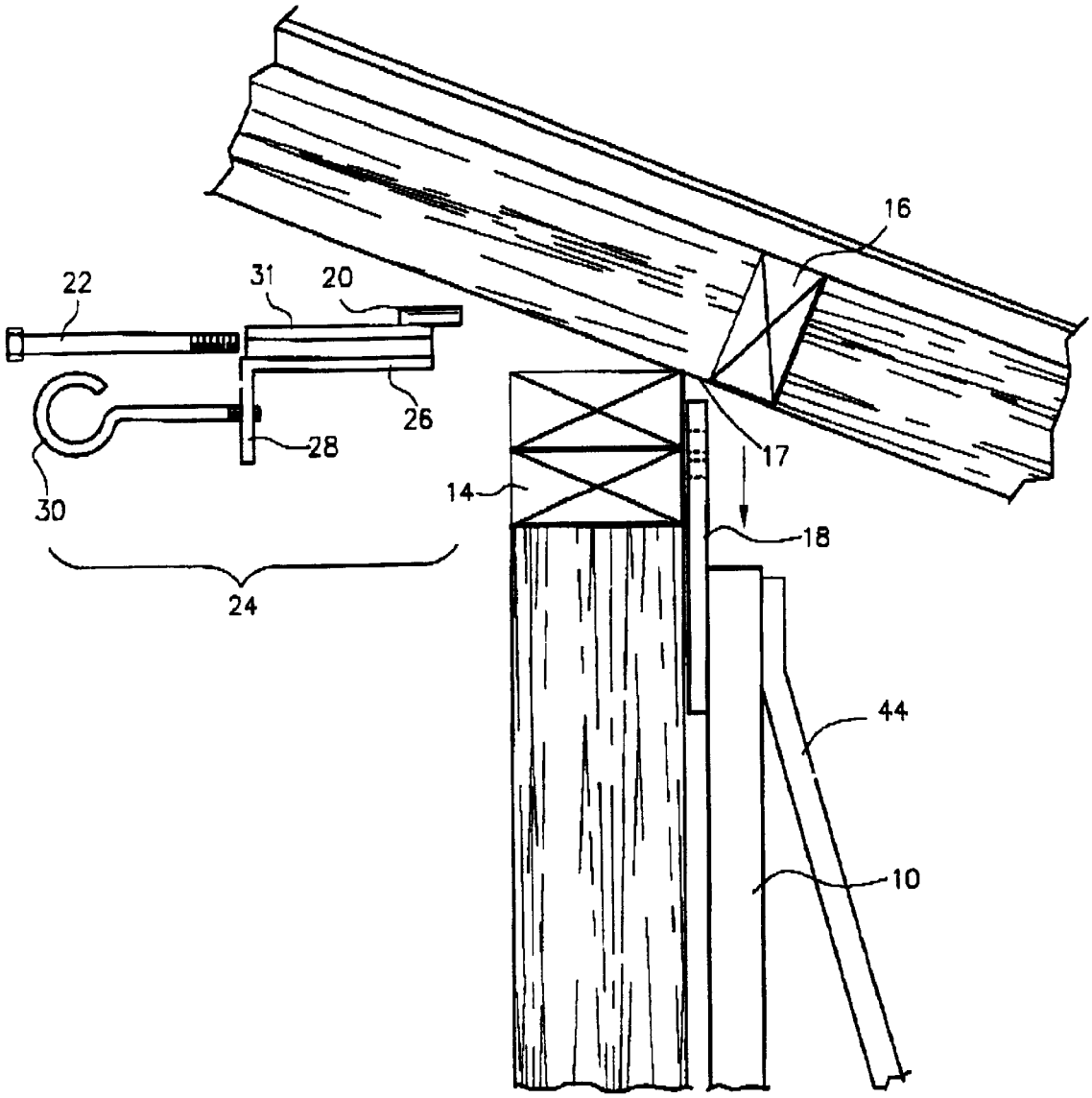
Figure 6:
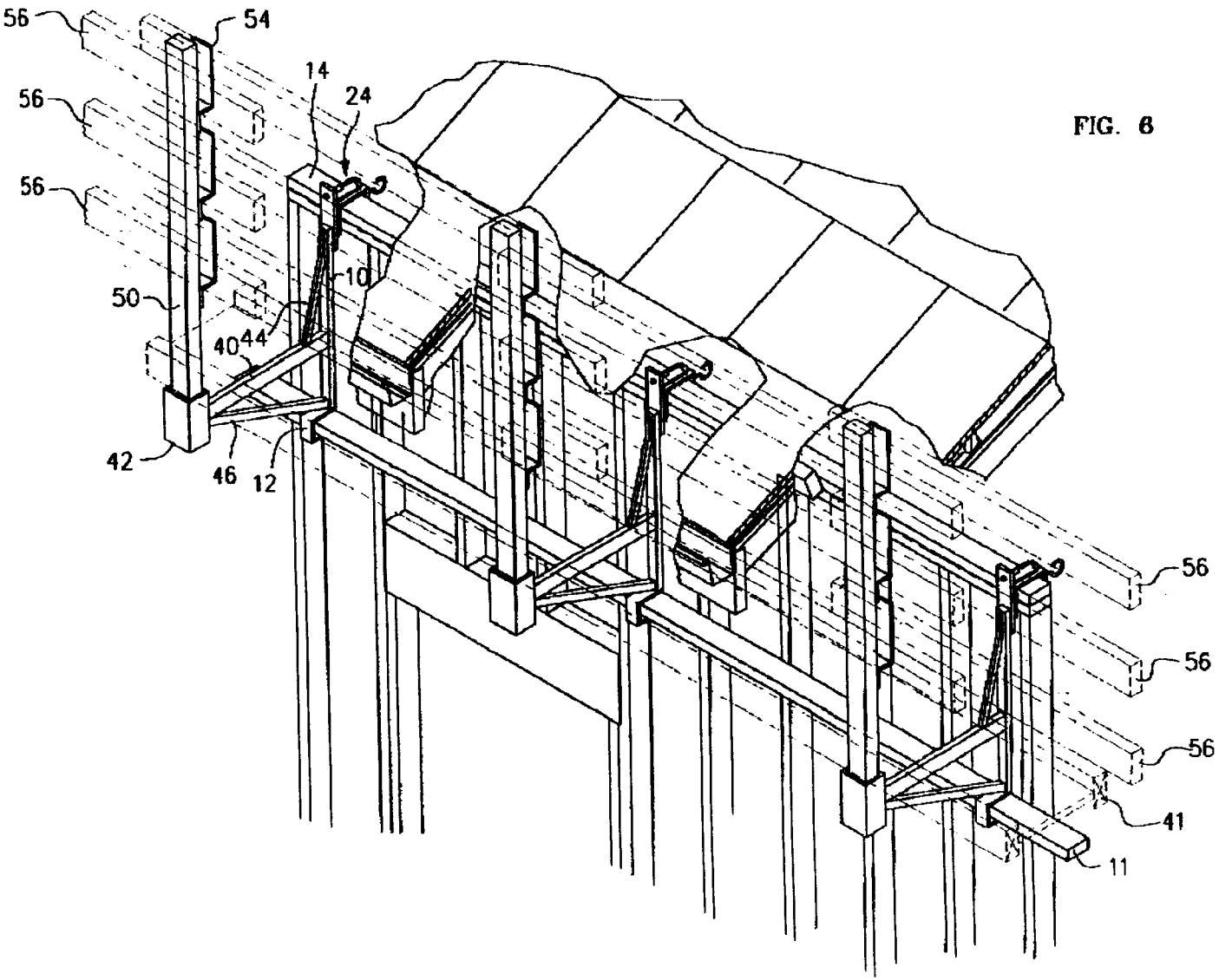

FIG. 5 is a partially exploded side view showing how one embodiment of the invention may be removed from a wall despite the presence of a complete roof system incorporating a frieze block; and FIG. 6 is a perspective view showing how one embodiment of the present invention may be used to construct a worker and equipment support surface including safety rails above ground level on an unfinished wall.

5. DETAILED DESCRIPTION OF THE PREFERRED EMBODIMENTS

The following description is of the best presently contemplated modes of carrying out the invention. This description is made for the purpose of illustrating the general principles of the invention and should not be taken in a limiting sense.

Figure 1:
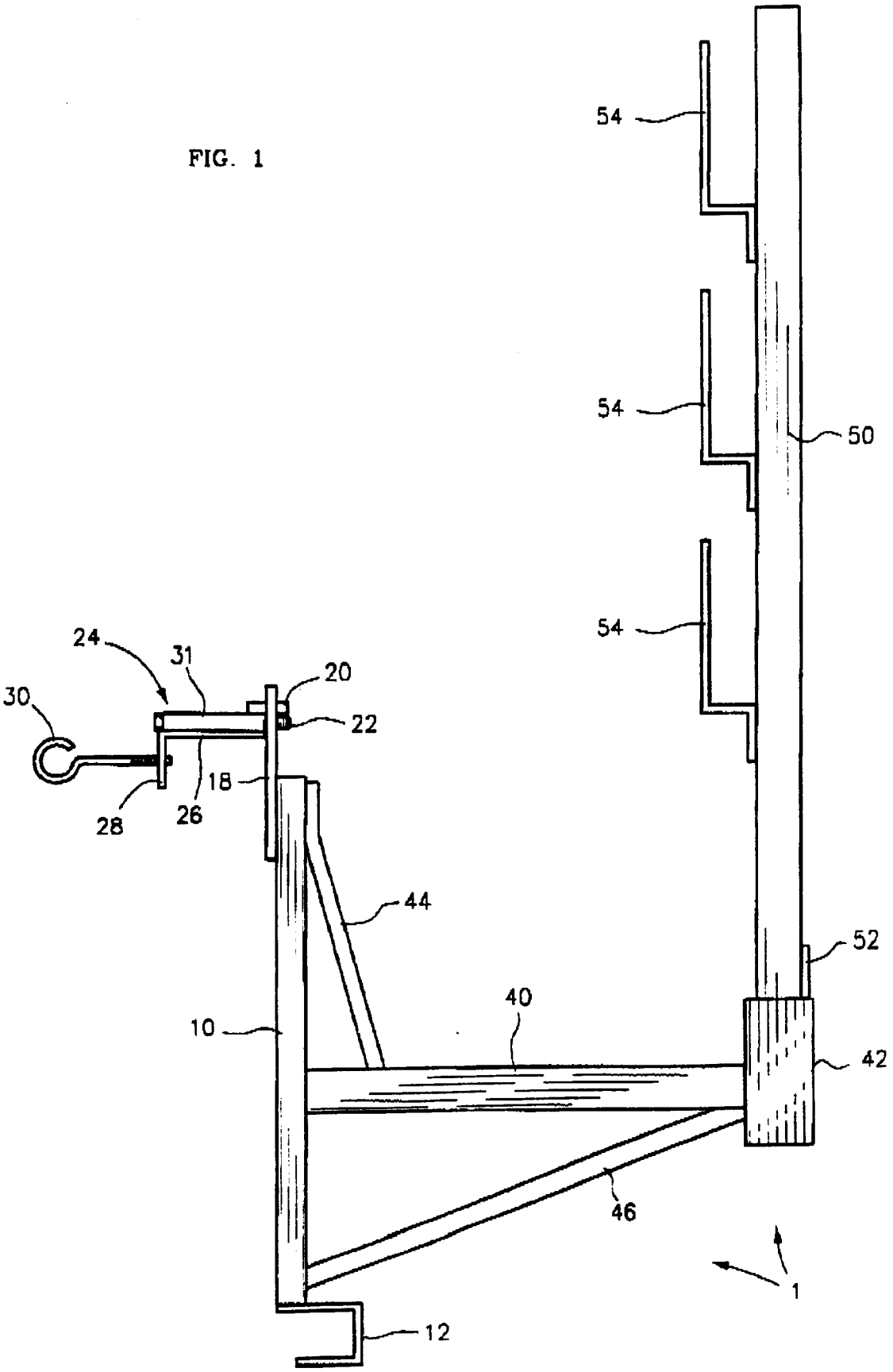
FIG. 1 is a side view of one embodiment of the present invention.
Figure 2:
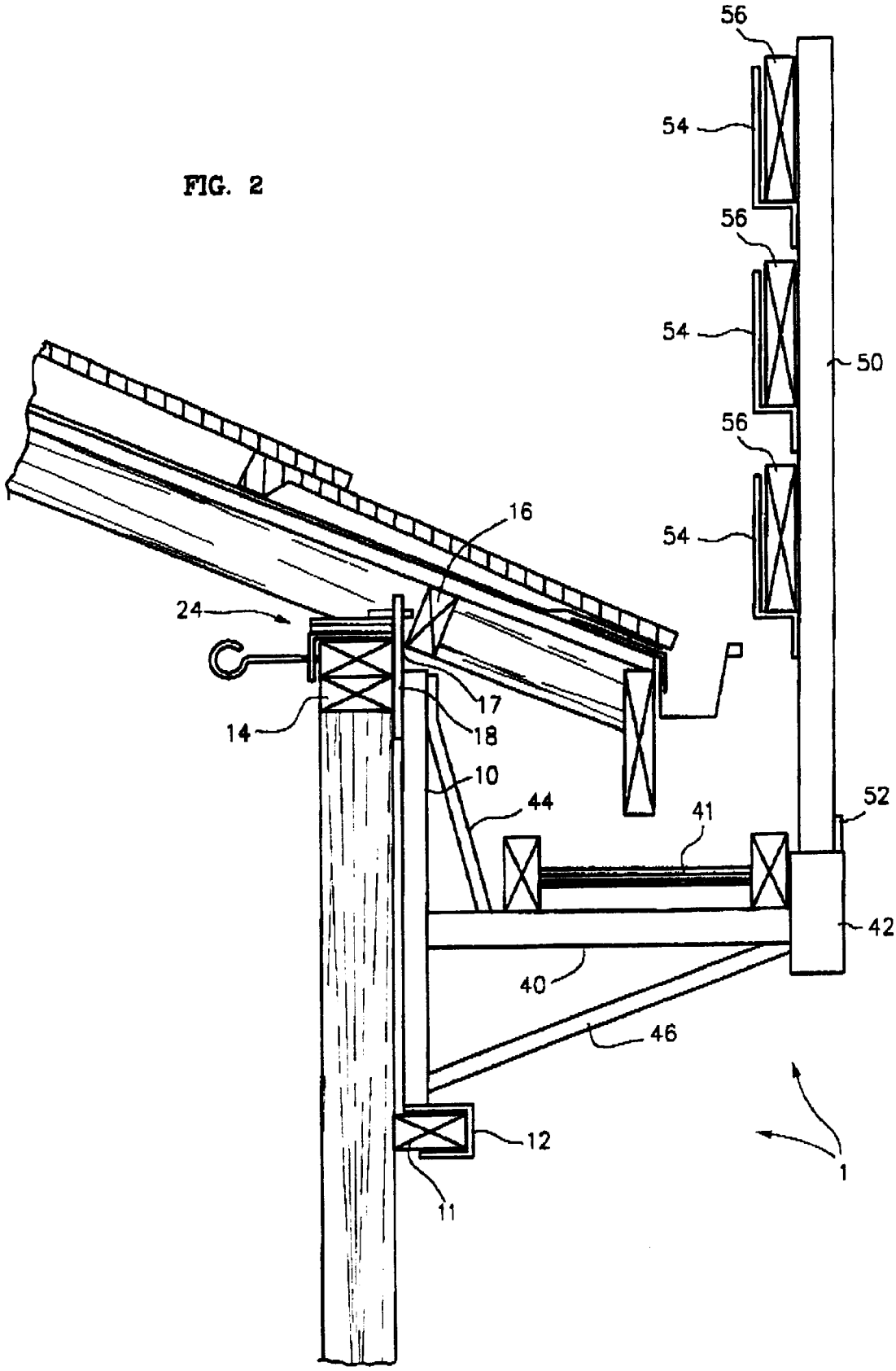
FIG. 2 is a side view showing one embodiment of the present invention installed on a wall and showing a completed roof system incorporating a frieze block.

As seen in FIG. 1, one embodiment of the invention comprises a vertical support 10 having an upper and a lower end. The upper end is adapted to receive a shear pin 20 and an attachment bolt 22 of a top plate clamp assembly designated generally as 24. As shown in FIGS. 2 & 4, the upper end of the vertical support 10 is further adapted to extend above the top plate 14 of a wall and to fit within gap 17 between top plate 14 and installed frieze block 16. This may be accomplished by attaching a tongue 18 to the vertical support 10 or by tapering the upper end of vertical support 10 such that it conveniently fits behind an installed frieze block 16. One reasonably skilled in the art will recognize that alternative ways of adapting the vertical support 10 to fit within gap 17 may be used.

The opposite end of the vertical support 10 may include a "C" bracket 12. As shown in FIG. 6, the "C" bracket 12 may be adapted to receive a piece of framing lumber or other type of support 11, typically 2"×4", to allow the scaffolding support to rest against a wall that is framed but not yet finished. Under such circumstances, the piece of framing lumber would span any gap between one vertical framing member and an adjacent vertical framing member. Such a gap may be present due to the typical 16" bays between vertical framing members or due to the presence of a door or window. The length of the piece of framing lumber may be selected to suit the particular circumstances and ensure that the lower end of the vertical support is braced against the vertical framing members of the wall. In addition, use of the support 11 distributes the force exerted by the lower end of the hanging scaffolding support 1 over multiple vertical framing members of a wall to which the scaffolding support 1 is attached. It is preferred to use a support 11 of at least 36" to distribute the force exerted by the lower end of hanging scaffolding support 1 over at least three vertical framing members of a wall. Note that the support 11 may be used to distribute such force even if the wall to which the hanging scaffolding support 1 is attached is sheathed.

The top plate clamp assembly 24 may comprise a horizontal plate 26, a wall tab 28 depending from the horizontal plate 26, a wall engaging bolt 30 passing through the wall tab 28, an attaching bolt holder 31 attached to the top of horizontal plate 26, an attaching bolt 20 passing through attaching bolt holder 31 and adapted to mate with the upper end of the vertical support 10, and a shear pin 20 attached to the horizontal plate 26 and adapted to mate with the upper end or tongue of the vertical support 10.

It is believed that shear pin 20 supports the majority of the weight of the scaffolding support. Accordingly, the shear pin 20 should have sufficient strength to support the anticipated loads that may be placed upon the scaffolding support, including, the support platform, workers, tools and materials. In the preferred embodiment of the invention, the shear pin is a ⅜" dowel made from ASTM A36 steel.

The attaching bolt 22 secures the engagement of the shear pin 20 with the vertical support 10. The attaching bolt holder 31 secures the attaching bolt to the top plate clamp assembly 24. The attaching bolt holder 31 also acts as a spacer allowing the use of a relatively long attaching bolt 32. Use of a relatively long attaching bolt 32 allows the head of the attaching bolt 32 to be positioned in an area of relatively easy access for someone who is installing or disassembling the bracket from the interior of a building.

One reasonably skilled in the art will appreciate that alternative means may be used to secure the top plate clamp assembly 24 to the vertical support 10. For example, the functions of the shear pin 20 and attaching bolt 22 may be combined by providing a shear pin adapted to extend through the vertical support and secured in place with a cotter or cotter pin. Note, however, that the use of a cotter or cotter pin may make removal of the scaffold inconvenient once a frieze block is installed. Alternatively, a bolt of sufficient strength extending into or through the vertical support may be used. Note, however, that use of only a bolt without a shear pin may result in damage to the bolt threads disengagement of the bolt from the vertical support 10 during disassembly of hanging scaffolding support 1. Although two examples of alternative means are presented, one reasonably skilled in the art will appreciate that additional alternative means of releasably attaching the top plate clamp assembly 24 to the vertical support 10 are available.

When tightened, the wall engaging bolt 30 draws the scaffolding support tight against the wall and assists in holding the scaffold support in position. In one embodiment of the invention, the wall engaging bolt is a bolt that may be tightened or loosened by hand such as an eye bolt. Thus, if the scaffolding support is located during the original installation at a location where a roof truss must be installed, the scaffolding support may be moved with minimal effort and without requiring any tools.

A horizontal support 40 is attached to the vertical support 10 between the upper and lower ends of the vertical support 10. The horizontal support 40 is adapted to support a worker and equipment support surface or platform 41. The support surface 41 may typically be one or more wood planks, however, any other suitable alternatives may be used such as platforms made of metal, polymer or composite materials. A socket 42 for removably receiving a vertical safety rail support 50 may be attached to the end of the horizontal support 40 not attached to the vertical support 10. The socket 42 may extend above the top surface of the horizontal support 40 to prevent the support surface 41 from sliding off of the end of the horizontal support 40. An angled brace 44 may be included connecting the vertical support 10 to the horizontal support 40. Although the angled brace 44 may lend some structural support to the scaffolding support, it also facilitates the installation of the support surface 41 by positioning the support surface toward the socket end of the horizontal support 40 away from the vertical support 10. Thus, the angled brace 44 and the raised socket 42 work in conjunction to position and secure the support surface 41. Accordingly, it may be desirable to design the distance between the point where the angled brace 44 intersects with the horizontal support 40 and the socket 42 to be a width commonly found in planks such as 12", 16" or 20".

A second angled brace 46 may be included to lend structural support to the horizontal support 40. As shown in FIG. 1, one end of the angled brace 46 may be attached to the lower end of vertical support 10 below the point at which horizontal support 40 intersects with vertical support 10. The other end of angled brace 40 may be attached to the bottom surface of horizontal support 40 at or near the socket 42.

As shown in FIG. 1, a vertical safety rail support 50 may be incorporated into the scaffolding support. The lower end of vertical safety rail support 50 is adapted to be removably received in socket 42. The ability to remove the vertical safety rail support 50 has several advantages. During the installation of the scaffolding support the vertical safety rail support 50 may be removed significantly reducing the weight of the scaffolding support thus easing installation of the scaffolding support. This is particularly significant because the scaffolding support is usually installed under somewhat awkward circumstances such as when a worker is up off of the ground. In addition, the ability to remove the vertical safety rail support 50 allows a damaged vertical safety rail support to be replaced rather than replacing the entire scaffolding support. Finally, the vertical safety rail support 50 may be removed for storage making the scaffold support more compact and easier to transport and store.

As shown in FIG. 1, a protrusion 52 is located a predetermined distance from the end of the vertical safety rail support that is adapted to be received by socket 42. When the vertical safety rail support 50 is placed within socket 42, protrusion 52 abuts the top edge of socket 42 thus positioning vertical safety rail support 50 properly within socket 42. One or more safety rail receivers 54 may be located on vertical safety rail support 50. Safety rail receivers 54 may be adapted to receive any desired dimension of safety rail but are preferably adapted to receive either 2"×4" safety rails or 2"×6" safety rails 56 as shown in FIG. 5. It may be desirable to design the safety rail receivers 54 to receive two safety rails 56 stacked on top of each other so that a continuous safety rail between all scaffolding supports 1 may be constructed when three or more scaffolding supports are placed in series. Such an arrangement is shown in FIG. 6.

To attach the scaffolding support 1 to a wall, the top plate clamp assembly 24 should be attached to the vertical support 10 by the appropriate attachment means such as shear pin 20 and attachment bolt 22. The scaffolding support is then hung over the top of the wall as shown in FIGS. 2 & 6. As mentioned above, it may be desirable to ensure that the vertical safety rail support 50 is not present in the socket 42 during installation to reduce the weight and bulk of the scaffolding support.

Once the scaffolding support 1 is hung over the wall, the wall engagement bolt 30 is tightened to draw the scaffold support up flush with the wall and to secure the scaffolding support. This process is repeated, hanging the second scaffolding support at a predetermined distance from the first scaffolding support. Note that such distance should allow the worker and equipment support platform 41 to span the distance between the two scaffolding supports. For example, the scaffolding supports may be hung on eight foot centers. As shown in FIG. 6, if the scaffolding support is to be hung on a portion of the wall that is framed but not finished such as in the middle of a standard 16" bay or in the middle of a window or door opening, a piece of lumber long enough to span the gap between the adjacent framing members should be installed in the "C" bracket 12 before the wall engaging bolt 30 is tightened.

Once all of the scaffolding supports are installed, the worker and equipment support platforms 41 should be placed on the horizontal supports 40 of the scaffolding supports 1. The worker and equipment support platforms 41 may overlap each other or abut to form a continuous platform or walkway if three or more scaffolding supports are used in series. Next, the vertical safety rail supports 50 should be installed in the sockets 42. Finally, one or more safety rails 56 should be installed in the vertical safety rail receivers 54. A complete scaffolding assembly showing three scaffolding supports installed in series on an unfinished wall is shown in FIG. 6.

Once installed in the above-described manner, the scaffolding provides fall protection for workers of all trades working above the eves of a roof. In addition, the scaffolding provides an area for workers to walk, work, and store equipment, tools, and materials. As shown in FIG. 2, because of the design of the vertical support 10 and because of the manner that the vertical support 10 releasably engages the top plate clamp assembly, a roof system utilizing a frieze block may be entirely completed, including installation of the frieze block 16, before the scaffolding is removed. The ability to entirely compete the installation of the roof before removing the scaffolding eliminates the need to use ladders or other impractical, time consuming, and/or expensive means of elevating workers, tools and materials to complete the roof installation.

To remove the scaffolding after installation of the roof, the safety rails 56 should first be removed from the safety rail receivers 54 of the vertical safety rail support 50. Next, the vertical safety rail supports 50 are removed. The next step is to remove the worker and equipment support platform 41. Finally, as shown in FIGS. 3 & 4, the vertical support 10 should be disengaged from the top plate clamp assembly 24. If an attachment bolt 32 is used, the bolt is simply loosened until it no longer engages the vertical support member 10. If a cotter pin type of attachment means is used, the cotter pin is removed. Note that the use of an attachment bolt 22 is preferred because it allows the top plate clamp assembly 24 to be disengaged by a worker positioned inside a building. In addition, use of the shear pin 20 and attaching bolt 22 allows the attaching bolt 22 to be removed without causing immediate disengagement of vertical support 10 from the top plate clamp assembly 24 due to the continued extension of shear pin 20 into or through vertical support 10. Thus, a worker has an opportunity to hold or otherwise secure the remainder of the scaffolding support 1 to prevent it from falling once the disengagement process is completed. The top plate clamp assembly 24 is then slid horizontally away from the vertical support member completing the disengagement process. At this point, the remainder of the scaffolding support will slide vertically down the outside of the wall thus slipping away from behind the installed frieze block as shown in FIG. 5.

To avoid injury or damage to equipment or materials, care should be taken to ensure that the scaffolding support will not fall on anyone or anything present below the position of the installed scaffolding support. If desired, a ladder may be used to hold the remainder of the scaffolding support during the disengagement process to prevent it from falling. Alternatively, if the walls are not yet finished so that only framing elements are present, a worker may reach through the framing members of the wall and grab the remainder of the scaffolding support from the inside of the building,

What is claimed is:

1. A wall securing assembly for a hanging scaffold support comprising:

a depending wall tab having an upper end;

a horizontal plate attached at an approximately perpendicular angle to said upper end of said depending wall tab;

said horizontal plate having an upper face and a lower face;

a tubular attaching bolt holder having an upper surface, a lower surface, and a central axis;

said lower surface of said attaching bolt holder attached to said upper face of said horizontal plate such that the central axis of said tubular attaching bolt holder runs approximately parallel to said upper surface of said horizontal plate;

a shear pin attached to said upper surface of said attaching bolt holder with one end of said shear pin protruding beyond an end of said horizontal plate distal to the attachment point of said depending wall tab;

an attaching bolt passing through said attaching bolt holder with an end of said attaching bolt protruding beyond an end of said horizontal plate distal to the attachment point of said depending wall tab; and a vertical support defining openings for releasably receiving at least a portion of said protruding end of said shear pin and at least a portion of said protruding end of said attaching bolt.

2. A hanging scaffold support comprising:

a depending wall tab having an upper end;

a horizontal plate attached at an approximately perpendicular angle to said upper end of said depending wall tab;

said horizontal plate having an upper face and a lower face;

a tubular attaching bolt holder having an upper surface, a lower surface, and a central axis;

said lower surface of said attaching bolt holder attached to said upper face of said horizontal plate such that the central axis of said tubular attaching bolt holder is approximately parallel to said upper surface of said horizontal plate;

a shear pin attached to said upper surface of said attaching bolt holder with one end of said shear pin protruding beyond an end of said horizontal plate distal to the attachment point of said depending wall tab;

an attaching bolt passing through said attaching bolt holder;

an end of said attaching bolt protruding beyond an end of said horizontal plate distal to the attachment point of said depending wall tab;

a tongue defining openings in an upper end of said tongue for releasably receiving at least a portion of said protruding end of said shear pin and at least a portion of said protruding end of said attaching bolt; and a vertical support attached to a lower end of said tongue.

* * * * *